US009398816B2

(12) United States Patent
Simmer et al.

(10) Patent No.: US 9,398,816 B2
(45) Date of Patent: Jul. 26, 2016

(54) UPPER BODY GARMENT WITH INFANT POUCH

(71) Applicant: Lalabu LLC, Atlanta, GA (US)

(72) Inventors: Garrett P. Simmer, Atlanta, GA (US); Brian J. Fosse, Atlanta, GA (US)

(73) Assignee: Lalabu LLC, Atlanta, GA (US)

( * ) Notice: Subject to any disclaimer, the term of this patent is extended or adjusted under 35 U.S.C. 154(b) by 75 days.

(21) Appl. No.: 14/151,901

(22) Filed: Jan. 10, 2014

(65) Prior Publication Data

US 2014/0197214 A1 Jul. 17, 2014

Related U.S. Application Data

(60) Provisional application No. 61/751,674, filed on Jan. 11, 2013.

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025
USPC ..... 224/159–160, 158, 646, 161; D3/214; 2/247
See application file for complete search history.

(56) References Cited

U.S. PATENT DOCUMENTS

| | | | | |
|---|---|---|---|---|
| 4,579,264 | A * | 4/1986 | Napolitano | 224/160 |
| 5,946,725 | A * | 9/1999 | Shatzkin et al. | 2/106 |
| 6,918,770 | B2 | 7/2005 | Odiwo | |
| 7,296,303 | B1 | 11/2007 | Samet | |
| 7,913,321 | B2 * | 3/2011 | Radcliffe et al. | 2/69 |
| 2004/0166766 | A1 * | 8/2004 | Schneider et al. | 450/36 |
| 2006/0005294 | A1 * | 1/2006 | Fugazzi | 2/115 |
| 2008/0149674 | A1 * | 6/2008 | Hiniduma-Lokuge | 224/159 |
| 2011/0119803 | A1 * | 5/2011 | Giroux | A41D 13/1245 2/113 |
| 2012/0199619 | A1 * | 8/2012 | Zack | 224/160 |
| 2012/0234877 | A1 | 9/2012 | Hiniduma-Lokuge | |
| 2013/0200116 | A1 * | 8/2013 | Arvan | 224/158 |

OTHER PUBLICATIONS

"Details for the Skin-to-Skin t-shirt," http://www.vija-design.com/index.php?lang=en&code=Peau-a-Peau, Dec. 28, 2012.

* cited by examiner

*Primary Examiner* — Corey Skurdal

(74) *Attorney, Agent, or Firm* — Womble Carlyle Sandridge & Rice LLP

(57) ABSTRACT

An upper body garment for supporting an infant adjacent the chest and upper belly of a wearer that includes a tubular garment body made from a stretchable fabric and comprising a front panel and a back panel, one or more breast panels extending from a top portion of the back panel and over the shoulders of the wearer; and a pouch panel extending from a lower portion of the breast panels. The pouch panel is secured along a U-shaped seam to an inside surface of the front panel to form a pouch with a top opening proximate the lower portion of the breast panels. The stretchable fabric is a two-way stretchable fabric with an increased capability for elastic expansion within a substantially horizontal plane when the wearer is in an upright position.

21 Claims, 12 Drawing Sheets

UPPER BODY GARMENT WITH INFANT POUCH

RELATED APPLICATIONS

This patent application claims the benefit of U.S. Provisional Patent Application No. 61/751,674, filed on Jan. 11, 2013, and entitled "UPPER BODY GARMENT WITH INFANT POUCH", which application is incorporated by reference in its entirety herein.

TECHNICAL FIELD

This disclosure relates generally to clothing and more specifically to an upper body garment having a pouch for carrying a small or newborn infant.

BACKGROUND

Parents of small children and toddlers generally have a variety of choices when selecting carriers for carrying their larger infants adjacent their upper bodies. However, parents of newborn children can often find it more difficult to find carriers suitable for supporting smaller infants who have not yet developed the neck strength to support their own heads. Consequently, in many cases a parent is often required to dedicate at least one entire arm, and often the second hand, to supporting and stabilize the body of the newborn child or small infant when carrying the child against her chest. While this situation can be entirely desirable when nursing, feeding, playing, and interacting with the child, this limitation can also restrict the ability of the parent to accomplish additional tasks while simultaneously carrying the child in a position adjacent her upper body. Thus, instead of maintaining the close contact with the infant for extended periods of time that can be advantageous and desirable for both the parent and child, the parent is often forced to place the child in a separate cradle or carrier in order to free her arms and hands to engage in additional activities.

A need therefore exists for a carrier for a newborn child or small infant that allows the parent to better maintain the close contact with the infant for extended periods of time while freeing the arms and hands of the individual to rest or to work on additional tasks. It is to the provision of such a carrier that addresses these and other needs that the present disclosure is primarily directed.

SUMMARY

Briefly described, an upper body garment that can be worn by a woman or a man to carry an infant. The garment includes a pouch having front panel and a pouch panel that are joined together along the sides and bottom edges to define an expandable pouch compartment having a top opening. A small or newborn infant is generally placed through the top opening of the pouch to be carried between the front panel and the pouch panel and adjacent to the chest and upper belly of the wearer.

In one embodiment, the garment generally includes a chest panel comprising a single piece of fabric or, in the case of a female wearer, a left breast panel and a right breast panel that can be pulled to the side for nursing the infant. This chest panel extends over the shoulders to attach to the top portion of a back panel of the garment. The back panel is in turn attached to a front panel that covers the front portion of the wearer's body, so as to create a garment that conforms to the wearer's upper body like a shirt, and that can also serves as the outer panel of the pouch. The garment also includes a pouch panel that is attached to or extends from a lower portion of the chest or breast panels, with the pouch panel being secured along a U-shaped seam to an inside surface of the front panel to form a pouch with a top opening proximate the lower portion of the chest or breast panels.

The front panel is formed from a stretchable material that allows the front panel to be stretched outwardly to open the pouch compartment to receive the infant. The stretchable material can be a two-way stretchable fabric (as opposed to a four-way stretchable fabric) that is more stretchable in one direction (e.g. the horizontal direction) than in another direction that is transverse to the first direction (e.g. the vertical direction), to prevent the pouch from sagging downward when it is occupied by an infant.

In another embodiment, the upper body garment includes a tubular garment body comprising a front panel and a back panel, and one or more chest or breast panels extending from a top portion of the back panel and over the shoulders of the wearer. The garment also includes a pouch panel secured along a U-shaped seam to the front panel to form a pouch with a top opening proximate the lower portion of the at least one breast panel. In addition, at least one of the front panel and the pouch panel is made from a two-way stretchable fabric having an increased capability for elastic expansion within a substantially horizontal plane, when the wearer is in an upright position, to expand the top opening of the pouch.

In yet another embodiment, a method of making an upper body garment for supporting an infant adjacent the chest and upper belly of a wearer that includes the steps of obtaining a garment body including a front panel, a back panel, at least one breast panel extending from a top portion of the back panel and over the shoulders of the wearer, and a pouch panel extending from a lower portion of the at least one breast panel, and with at least the front panel being made from a stretchable fabric. The method further includes inserting the pouch panel between the back panel and the front panel, and securing the pouch panel to an inside surface of the front panel along a U-shaped seam to form a pouch with a top opening proximate the lower portion of the at least one breast panel.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present disclosure described herein.

DETAILED DESCRIPTION

Illustrated in FIGS. 1-10 are several representative embodiments of upper body garment for securing, supporting or carrying an infant adjacent the chest and upper belly of a wearer. The disclosure also includes one or more methods for making the upper body garment. As described in more detail below, the upper body garment can provide several significant advantages and benefits over other type garments or support system for carrying infants next to the upper body of the wearer. It is noted, however, that the recited advantages are not meant to be limiting in any way, as one skilled in the art will appreciate that other advantages may also be realized upon practicing the present disclosure.

Figure 1A:
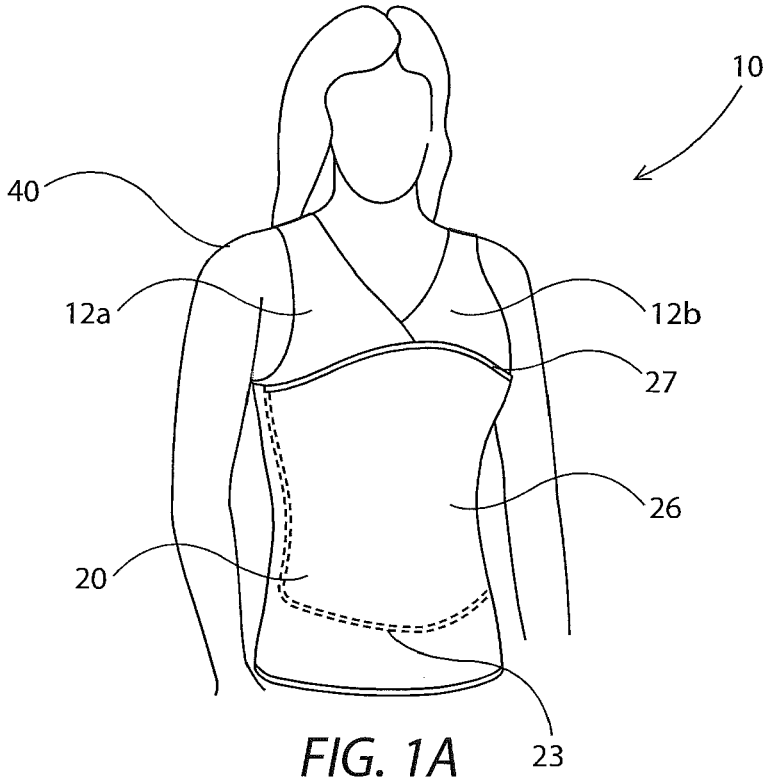
FIGS. 1A-1G are front perspective views of the upper body garment being worn by a woman and in various stages of positioning and supporting an infant within a pouch formed into the garment, in accordance with a representative embodiment.

Referring now in more detail to the drawing figures, wherein like parts are identified with like reference numerals throughout the several views, FIG. 1A shows the upper body garment 10 of the present disclosure being worn by a woman 40 and having a pouch 20 positioned on the front of the woman's torso. The pouch 20 includes an outer panel 26 which serves as the front portion of the garment to cover the front of the woman's body, and an inner panel (not shown). The outer panel 26 of the pouch 20 is constructed of a stretchable fabric or material that allows for the outer panel 26 to expand outwardly in at least one direction. The upper body garment 10 of FIG. 1A can further include a right breast panel 12*a* and left breast panel 12*b* which are positioned over the woman's chest and above the pouch 20. In one aspect, the top edge 27 of the outer panel 26 can include a rolled reinforcement portion or seam which defines and strengthens the top edge 27.

FIG. 1A shows the upper body garment 10 being worn by an adult female 40, but it is to be appreciated that, in general, the garment 10 could be worn by a person of any age or sex. In addition, while the upper body garment 10 is typically configured with the pouch 20 positioned on the front of the garment, it is also contemplated that the garment may be configured so that the pouch 20 could be worn on the back of the wearer's body. Furthermore, while FIG. 1A shows the person wearing the garment while standing upright, the garment 10 is also intended be worn while the person is lying down, sitting, walking, exercising, or engaging in any typical physical activity, especially those activities which involve interaction with small or newborn infants.

Figure 1B:
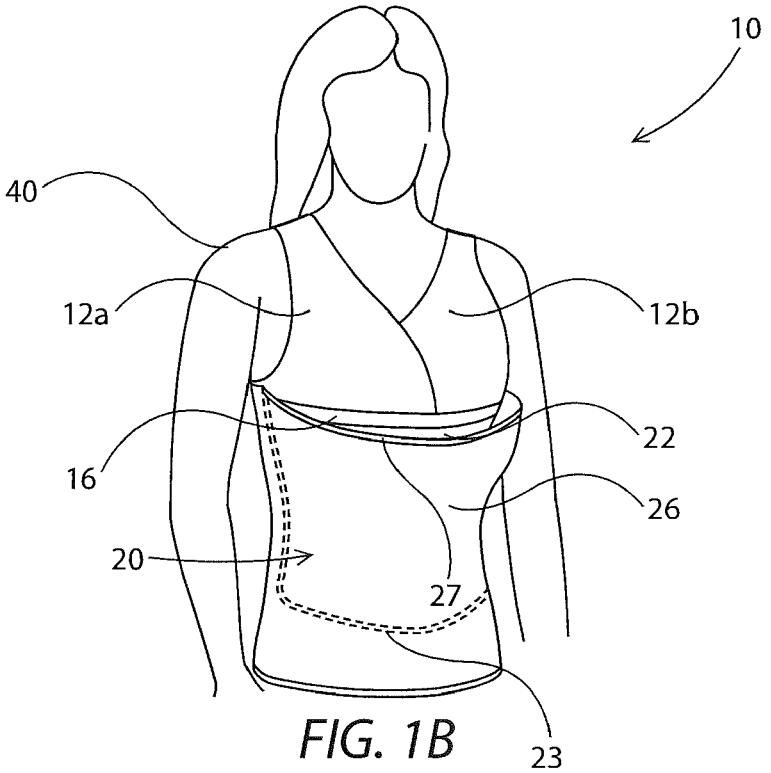

FIG. 1B shows the upper body garment 10 being worn by the woman 40 and with the top edge 27 the outer panel 26 of the pouch 20 having been pulled away from the front of her body to reveal an elastic breast support 16 located above the inner panel 22. The elastic breast support 16 may be attached to the right breast panel 12*a* and the left breast panel 12*b* by stitching, bonding such as by sonic welding or adhesive, or by any other technique or method known to one of skill in the art for attaching together fabrics or fabric panels. The elastic breast support 16 may also be attached to the inner panel 22 by stitching, bonding or other attachment technique or method. In addition, the inner panel 22 of the pouch 20 may also be attached to the outer panel 26 along a U-shaped seam or attachment line 23 by stitching, bonding or other attachment technique or method.

Figure 1C:
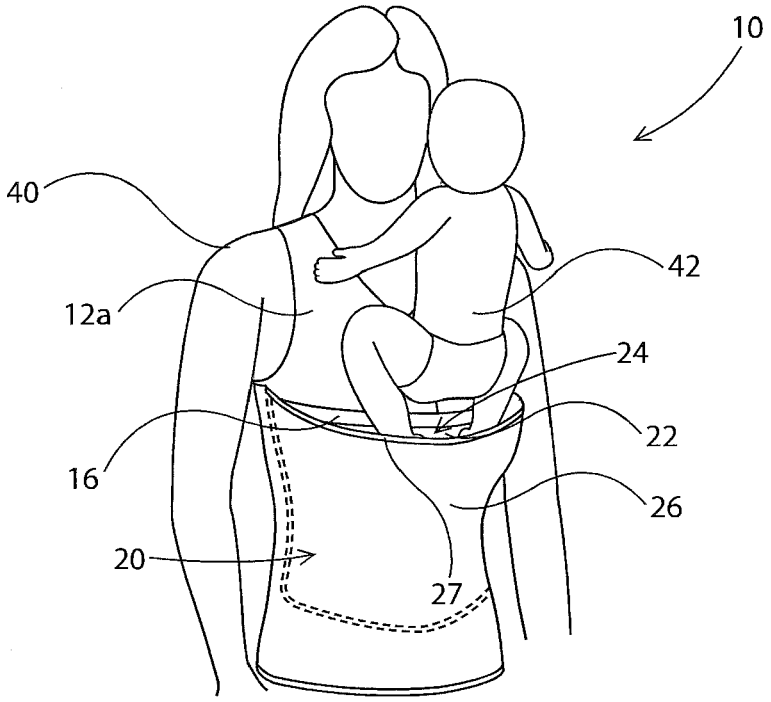
Figure 1D:
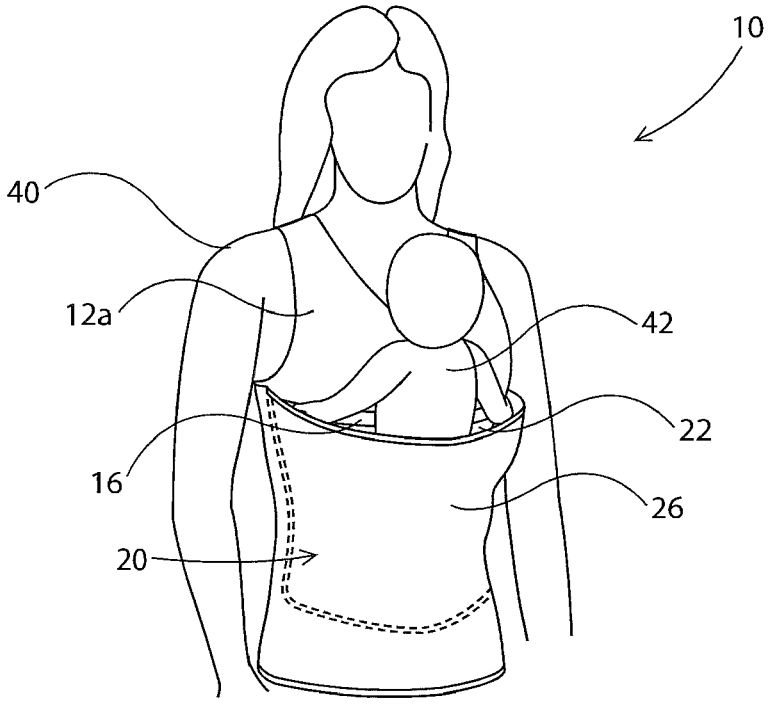

FIG. 1C shows the upper body garment 10 having the top edge 27 of the outer panel 26 of the pouch 20 pulled away from the woman's body to create a top opening 24 between the inner panel 22 and the outer panel 26 that is large enough to receive an infant 42. The infant 42 is generally inserted into the pouch 20 through the opening 24 beginning with its feet, as illustrated. However, smaller infants 42 may also be inserted into the pouch 20 beginning with their rear ends. The pouch 20 can be sized and/or configured so that at least the entire lower body of the infant can fit within the pouch 20, as shown in FIG. 1D. In one aspect, the pouch can be sized and configured to receive infants weighing up to about 15 lbs, which children can generally range in age from newborn to about four or five months.

Figure 1E:
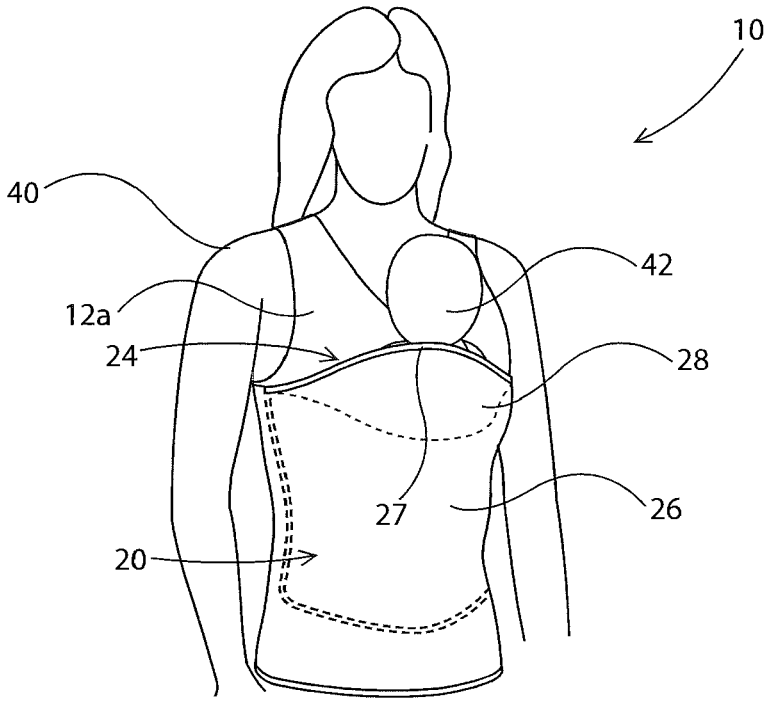

FIG. 1E shows the infant 42 being held in the pouch 20 of the upper body garment 10 between outer panel 26 and the inner panel 22, which can provide a barrier that separates the infant 42 from the chest and upper belly of the wearer 40. The outer panel 26 of the pouch 20 has been stretched outwardly and pulled up to a height so that the fabric proximate the top edge 27 of the outer panel 26 secures the infant 42 around its neck and shoulder area. The outer panel 26 can be substantially elastic or stretchable so that the top edge 27 may be pulled to other positions, including the head area of infant 42 or armpit area of infant 42. In one aspect, the outer panel 26 can include a foldable flap or head support 28 which extends from or is attached to the top edge 27 of opening 24 by stitching, bonding or other attachment technique or method, and which can be folded down within the pouch 20 when not in use, as illustrated in FIGS. 1A-1D.

Figure 1F:
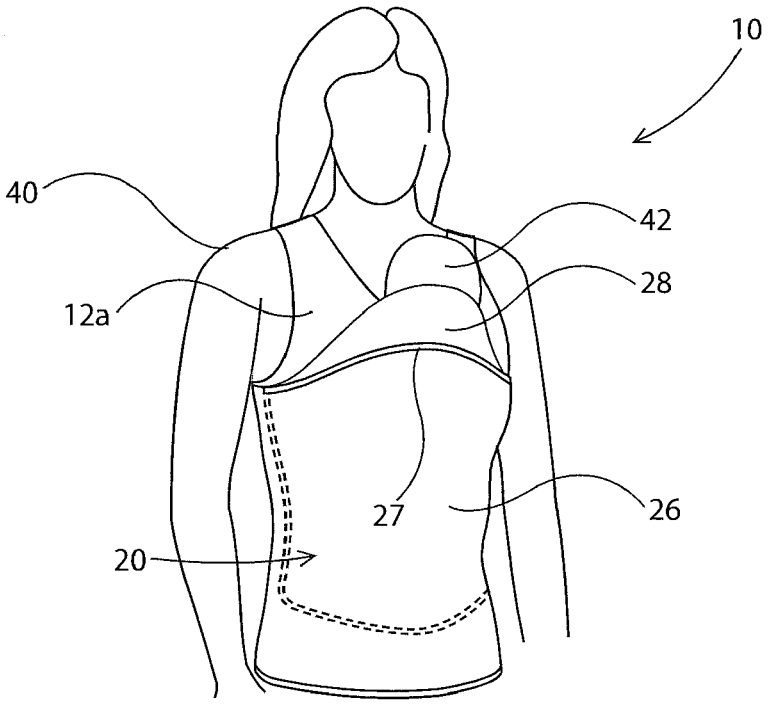

FIG. 1F also shows the infant 42 being held in the pouch 20 of the upper body garment 10 between outer panel 26 and the inner panel, and with the top edge 27 of the outer panel 26 having been stretched or pulled up to a height that secures the infant 42 around its neck and shoulder area, and with the head support 28 being at least partially pulled up around the head of the infant 42. In one aspect, the head support 28 may also comprise a stretchable fabric that allows for the material of the head support 28 to expand, but in other embodiments may also be constructed of a non-stretchable fabric so as to provide a firmer support for the head of the infant.

Figure 1G:
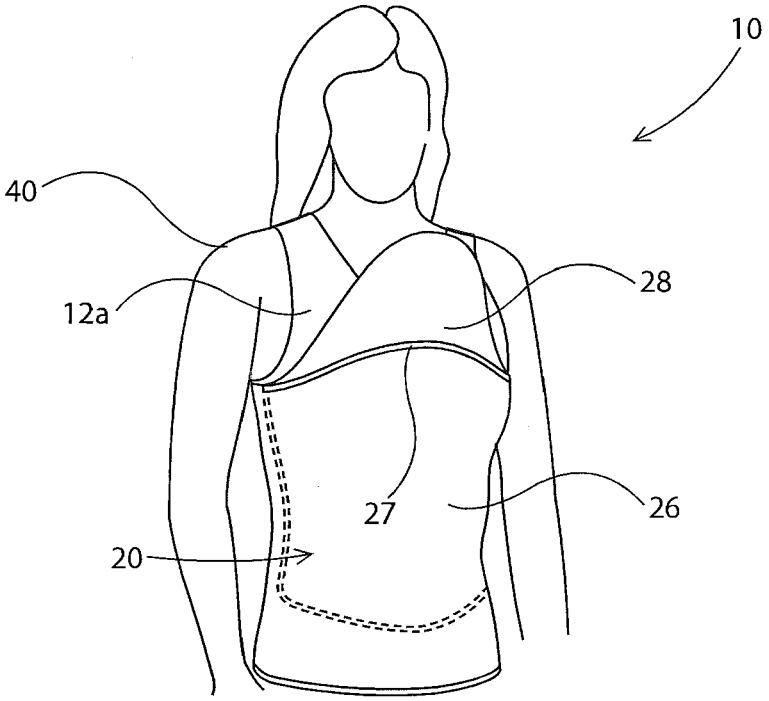

FIG. 1G also shows the infant being held in the pouch 20 of the upper body garment 10 between outer panel 26 and the inner panel with the top edge 27 of the outer panel 26 having been stretched or pulled up to a height that secures the infant around its neck and shoulder area, and the head support 28 having been stretched or pulled completely up over the head of the infant so as to provide additional protection, privacy, support and comfort for the woman 40 and child.

FIGS. 1A-1G further disclose a method for wearing and using the upper body garment 10, in which the wearer can put on the upper body garment 10 much like a shirt. The garment 10 is placed over the torso with the outer panel 26 of the pouch 20 positioned on the front of the wearer. To allow for the carrying of an infant, the top edge 27 of the outer panel 26 is stretched away from the inner panel 22, creating opening the pouch 20 into which the infant can then be inserted. The infant can then be positioned within the pouch 20 between the outer panel 26 and the inner panel 22, with its head resting against either the outer panel 26, the inner panel 22, or being supported by the hand of the wearer, and its feet placed at the bottom of the pouch beneath it. For larger infants, the optional head support 28 may be raised, cradling the infant's head and supporting it from falling away from the wearer's torso. To remove the infant, the wearer reaches into the opening 24 and pulls the infant up and out of the pouch 20. The outer panel 26 of the pouch 20 will then contract to its original size, thereby giving the upper body garment 10 a smaller size and enabling the wearer to continue to wear it comfortably with no infant inside it. In one aspect, the chest portion of the garment 10 is comprised of a right breast panel 12*a* and a left breast panel 12*b*, which can be modeled after existing nursing bras that allow the wearer to stretch either the right breast panel 12*a* and a left breast panel 12*b* aside to expose the breast during breast feeding.

Figure 2:
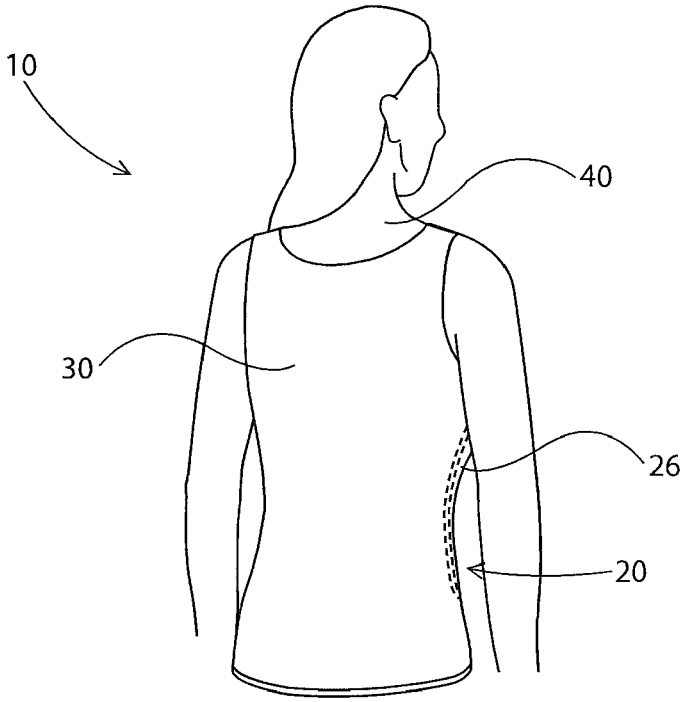
FIG. 2 is a rear perspective view of the of the upper body garment of FIGS. 1A-1G being worn by a woman.

FIG. 2 is a rear perspective view of the upper body garment 10 being worn by the woman 40 and having a back panel 30 that is positioned against the back of the woman's body. As described in more detail below, the back panel 30 and the outer panel 26 of the pouch 20 can be portions of the same piece of stretchable fabric that has been shaped or woven into a generally tubular, unitary garment, and that is configured to fit the upper body of the wearer like a shirt or blouse. Alternatively, the back panel 30 and the outer panel 26 of the pouch 20 can be two separate pieces of fabric that are joined together through stitching, bonding or other attachment technique or method, in which case the material or fabric forming the back panel 30 of the garment 10 may or may not be stretchable, or may be stretchable in a manner that is different from the stretchable outer panel 26 of the pouch 20.

Figure 3:
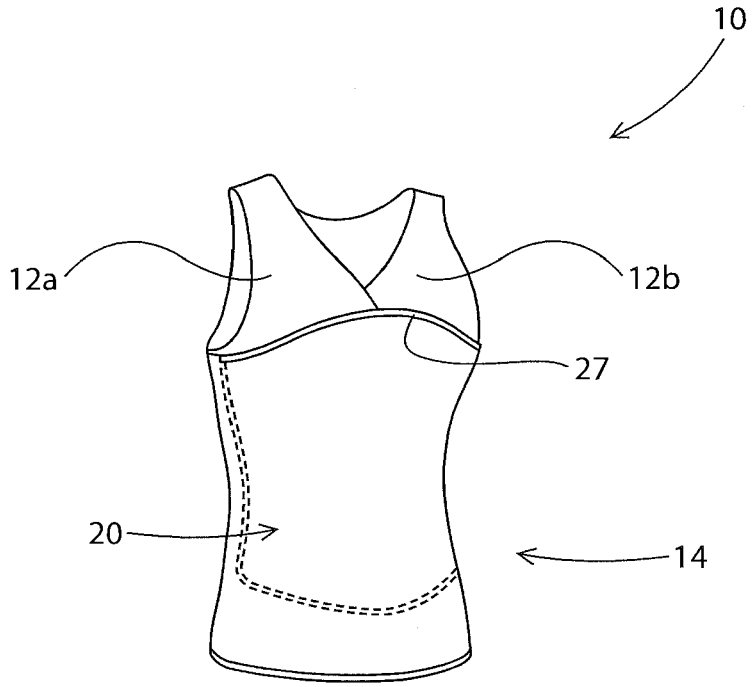
FIG. 3 is a front perspective view of the upper body garment of FIGS. 1A-1G.
Figure 4:
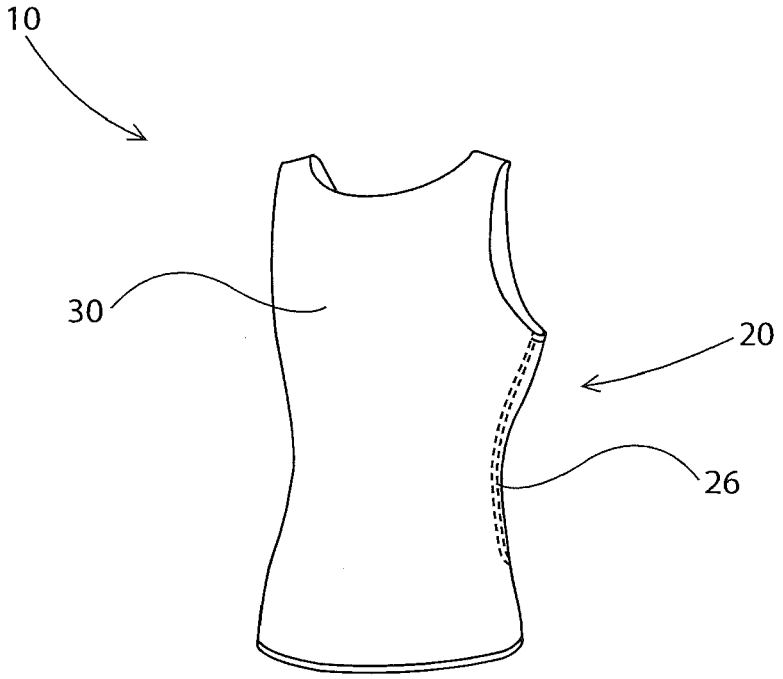
FIG. 4 is a rear perspective view of the upper body garment of FIGS. 1A-1G.

FIGS. 3 and 4 show the upper body garment 10 in isolation, with the pouch 20 formed into the front portion 14 of the garment and the right breast panel 12*a* and the left breast panel 12*b* positioned above the top edge 27 of the outer panel 26. As stated above, the outer panel 26 of the pouch 20 can comprise a stretchable fabric or material that allows for the fabric to elastically expand in at least one direction. In one aspect the stretchable fabric or material can be a two-way stretchable fabric that is stretchable in a horizontal direction while being substantially less stretchable in a transverse or vertical direction. As used herein, "two-way" stretch is a term of art that describes a fabric or material that is stretchable in opposite directions along a single line, and which is less stretchable in opposite directions along a second line that that is transverse or perpendicular to the first line. Thus, as known to one of skill in the art, a fabric that is equally stretchable in all directions would be considered a "four-way" stretchable fabric. Other groupings, orientations and angles for the fibers forming the stretchable fabric are also possible, such as when two sets of two-way stretchable fibers are aligned at oblique angles to each other or to a set of less-stretchable fibers to form a stretchable fabric with a designed, multi-directional controlled stretch.

In other words, the two-way stretchable fabric can elastically expand more in the horizontal direction than in the vertical direction, and can elastically return to its initial dimensions without tearing or permanent deformation of the fibers that form the fabric. In one aspect, the two-way stretchable fabric can elastically expand more in the horizontal direction than the vertical direction by a ratio of at least about 3:1, and in another aspect by a ratio of at least about 5:1. In one embodiment, for example, the two-way stretchable fabric can be a ponte roma knitted fabric that is double-knit for added stability and durability, and can further comprise a 72% Poly, 24% Rayon, and 4% Spandex blend. However, other two-way stretchable fabrics having different fiber blends and knitting constructions can also be used to construct the upper body garment, and therefore may also be considered to fall within the scope of the present disclosure.

Making the outer panel 26 of the pouch 20 from a fabric or material that is configured to stretch in a horizontal direction and to resist or limit stretching in a vertical direction ensures that the outer panel 26 generally stretches outward or horizontally, and not upward or downward, from the wearer's body when the pouch 20 is pulled open to receive the body of the infant. This feature of the garment 10 can function to maintain and support the infant against the chest and upper belly of the wearer, and can to prevent the occupied pouch 20 from sagging downward and the infant from slipping down the wearer's body to rest against the lower belly or waist of the wearer.

The back panel 30 of the garment 10 can also comprise a stretchable fabric or material, including the two-way stretchable material forming the outer panel 26. When the back panel 30 is also formed from a stretchable fabric, whether as part of the same piece of stretchable fabric as the outer panel 26, or formed separately and attached to outer panel 26 by stitching, bonding or other attachment technique or method, the back panel 30 can operate to accommodate a portion of the elastic stretch of the outer panel 26 of the pouch 20. In other words, the elastic stretch or extension of the fabric forming the outer panel 26 of the pouch 20 can be spread around the wearer's sides and/or across the expanse of the wearer's back, instead of stretching only from the front portion 14 of the garment 10. By expanding the area of the stretched material to incorporate the sides and/or back of the garment, the stretch can be more uniformly distributed around the wearer's body and the stress on any particular portion can be reduced, with a corresponding reduction in the wear and tear on the garment.

The shoulder portions of the upper body garment 10 may also be formed from a fabric or material that is non-stretchable or which is two-way stretchable in the horizontal direction, so as to prevent the shoulder portions from stretching in the vertical direction and allowing the entire garment to sag vertically. In contrast, the right breast panel 12*a* and the left breast panel 12*b* may be formed, at least in part, from a two-way stretchable or a four-way stretchable material that allows the breast panel to be easily pulled aside for nursing.

Figure 5A:
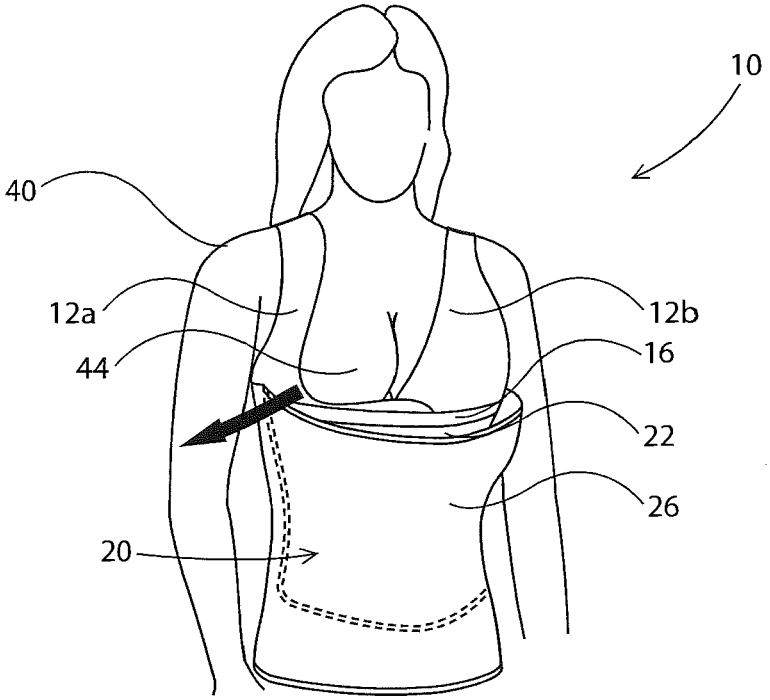
FIGS. 5A-5B are front perspective views of the upper body garment of FIGS. 1A-1G being worn by a woman and in various stages of nursing an infant.
Figure 5B:
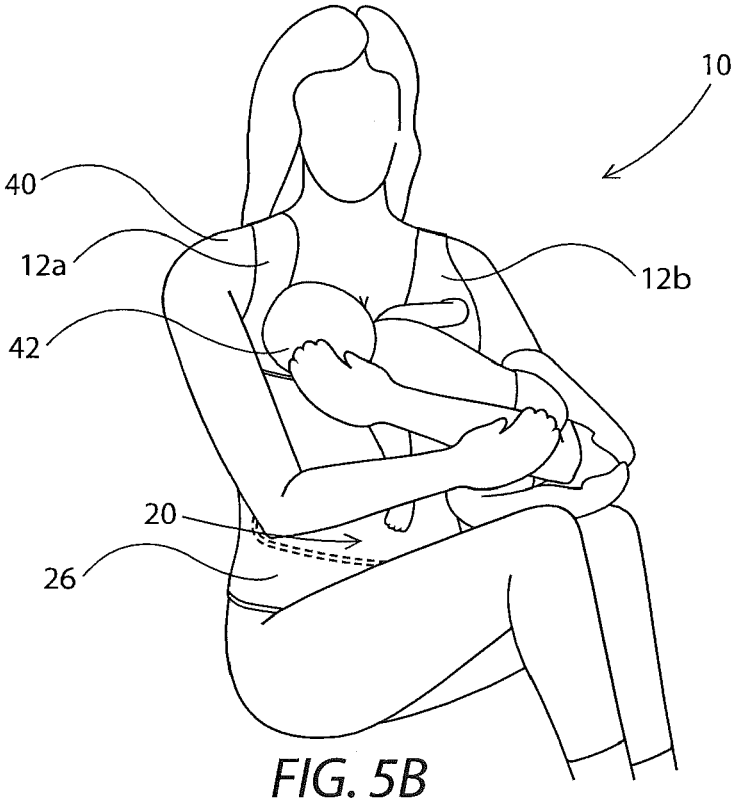

FIG. 5A shows the upper body garment 10 being worn by the woman 40, and with the outer panel 26 of the pouch 20 being pulled down to reveal the elastic breast support 16. Right breast panel 12*a* has also been pulled to the side of the woman's breast 44 to allow for the infant to access the breast 44. FIG. 5A shows the right breast panel 12*a* being pulled to the side, but it may also be the left breast panel 12*b*. While it may be possible for the infant 42 to be positioned within the pouch 20 between the outer panel 26 and the inner panel 22 when nursing, it is generally preferred that the infant 42 be removed from the pouch 20 and held in the woman's arms while nursing, as shown in FIG. 5B.

Figure 6A:
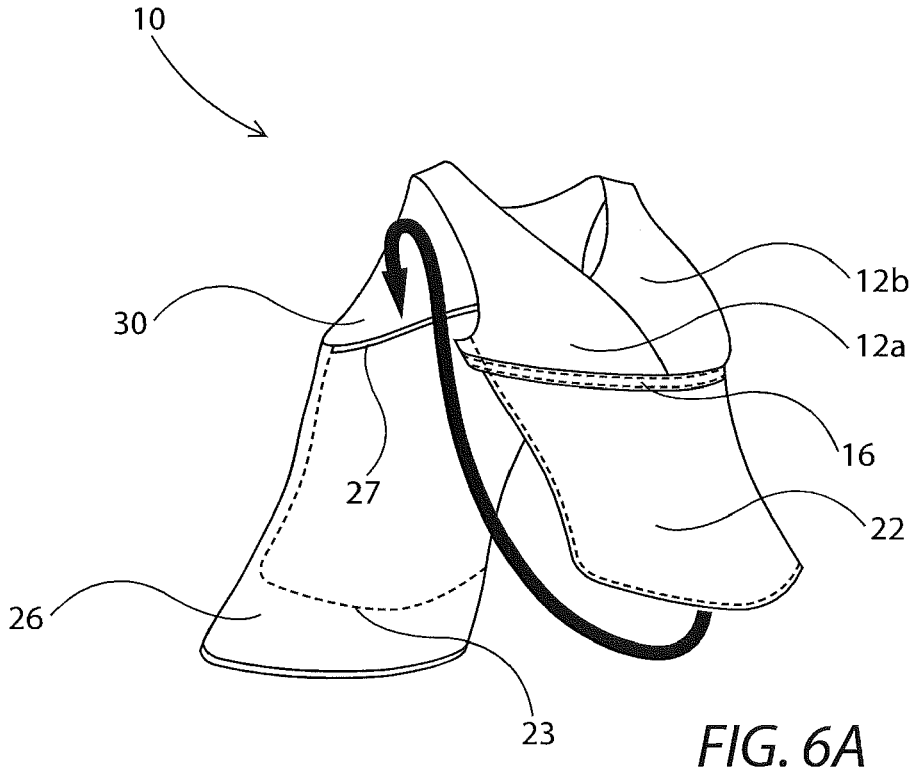
FIG. 6A is a front perspective view of a method for making the upper body garment of FIGS. 1A-1G.

FIG. 6A shows the upper body garment 10 during construction, in accordance with the representative embodiment described above. The elastic breast support 16 can be attached to both the right breast panel 12*a* and the left breast panel 12*b*, which can be extensions of a unitary piece of stretchable fabric or material forming the back panel 30 of the garment 10. Thus, as illustrated in the embodiment of FIG. 6A, each of the outer panel 26, the back panel 30, and the right and left breast panels 12*a*, 12*b*, respectively, can be shaped or cut from the same piece or swath of stretchable material or fabric. For example, more like athletic wear or intimate apparel, the fabric forming the outer panel 26 and back panel 30 of the garment 10 may be knit into a unitary tubular shape, thereby reducing the number of seams. To give it a simpler look and more comfortable feel for the wearer and infant, the distinct fabric pieces may also be sonically welded together instead of stitched.

The inner panel 22 of the pouch 20 may also be formed from the same stretchable fabric or material forming the outer panel 26 of the pouch 20 and, optionally, the back 30 of the garment 10. In the alternative, the inner panel 22 of the pouch 20 may be formed from a different piece of material or fabric that is subsequently attached to the elastic breast support 16 or to the lower portions of the right breast panel 12*a* and the left breast panel 12*b* by stitching, bonding or other attachment technique or method.

In cases where the inner panel 22 comprises a different piece of material or fabric, the material or fabric of the inner panel 22 can be provided with different characteristics, and may or may not be stretchable. For example, in some aspects it may be desirable that inner panel 22 comprise a less-stretchable or water-resistant fabric that is softer or provides greater insulation than the stretchable fabric forming the outer panel 26, in order to increase the comfort of the wearer or infant.

During construction, the inner panel 22 can be positioned inside the outer panel 26 and attached to the outer panel 26 by stitching, bonding or other attachment technique or method along attachment line 23. With the inner panel 22 positioned inside the outer panel 26 that forms the front portion of the garment 10, the structure of the pouch 20 can be less visible or even non-visible to others when it not being used to hold and support an infant, with the only indication being the attachment line 23 or seam where the inner panel 22 is secured to the inside surface of the outer panel 26. This can provide the front of the upper body garment 10 with a smooth and uniform appearance, especially in embodiments where the inner panel 22 is attached with bonding (e.g. sonic welding, adhesive, etc.) so that no stitching is observable on the front portion 14 of the garment 10 (FIG. 3).

Figure 6B:
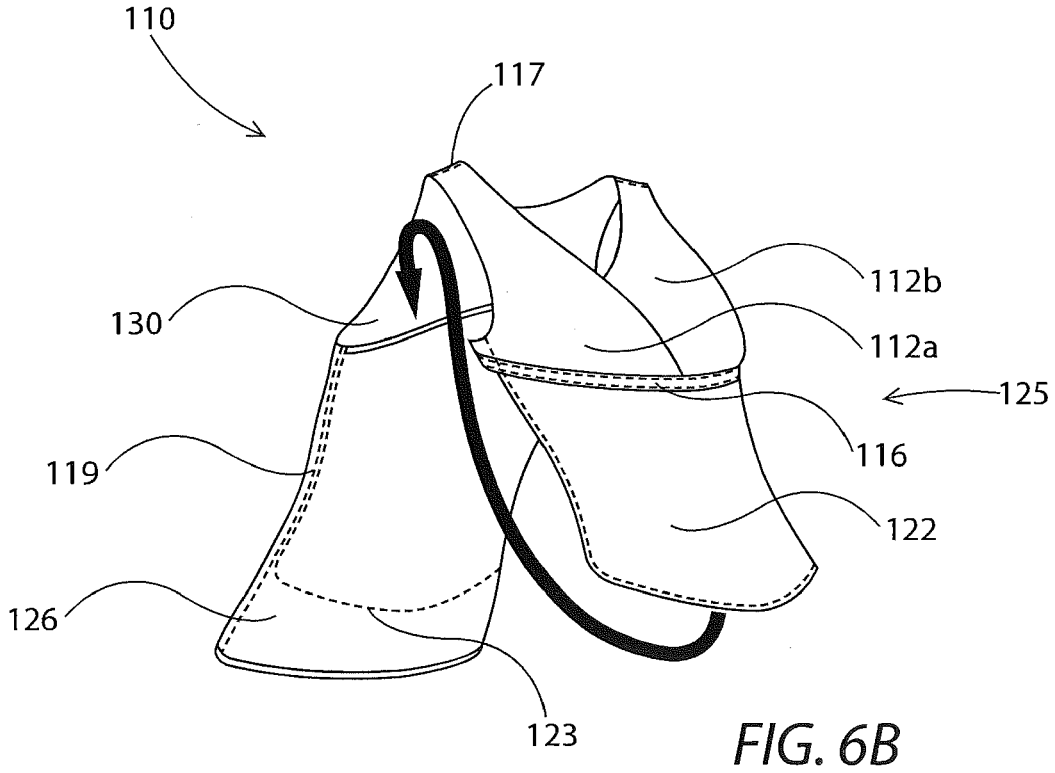
FIG. 6B is a front perspective view of a method for making the upper body garment, in accordance with another representative embodiment.

FIG. 6B illustrates the construction of another representative embodiment of the upper body garment 110, in which the right breast panel 112*a*, the left breast panel 112*b*, the elastic breast support 116, and the inner panel 122 are four separate parts which are attached together to form an interior, front assembly 125 of the garment 110. In turn, the upper ends of the left breast panel 112*a* and right breast panel 112*b* are attached to the back panel 130 along horizontal seams or attachment lines 117, and the back panel 130 is in turn attached to the outer panel 126 of the pouch 120 along vertical seams or attachment lines 119. As stated above, each of the panels may be attached to any other panel by stitching, bonding or other attachment technique or method. During manufacture, the inner panel 122 can be positioned inside the outer panel 126 and attached to the inside surface of the outer panel 126 along U-shaped attachment line 123 by stitching, bonding or other attachment technique or method.

Figure 7A:
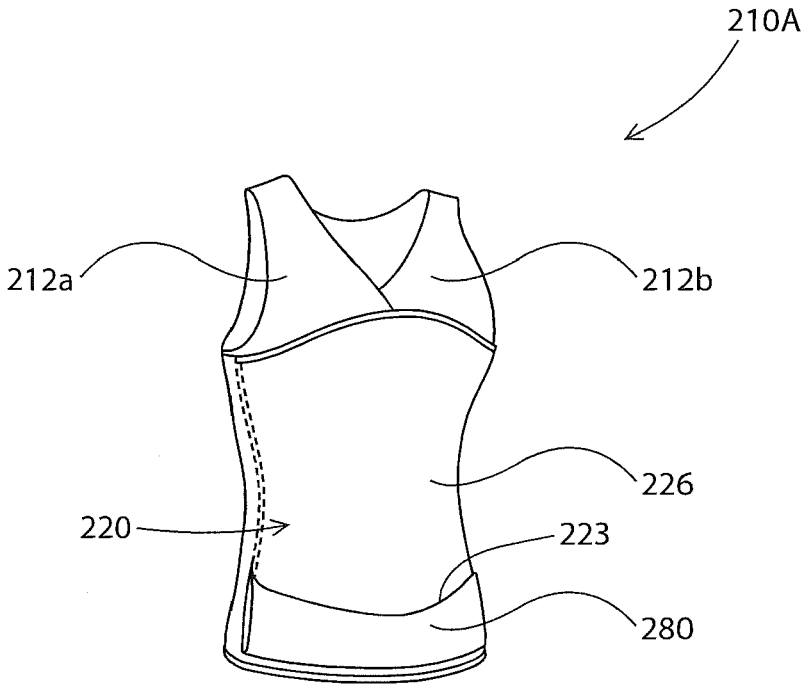
FIGS. 7A-7D are front perspective views of the upper body garment, in accordance with additional representative embodiments.

FIG. 7A shows another representative embodiment of the upper body garment 210A in which an additional hand pocket 280 is attached to the outer panel 226 of the pouch 220 below the lower portion of the attachment line 223 where the inner panel is attached to the outer panel 226. Hand pocket 280 can be attached to outer panel 226 of the pouch 220 by stitching, bonding or other attachment technique or method, and may be used to carry objects such as a mobile phone or baby accessories.

Figure 7B:
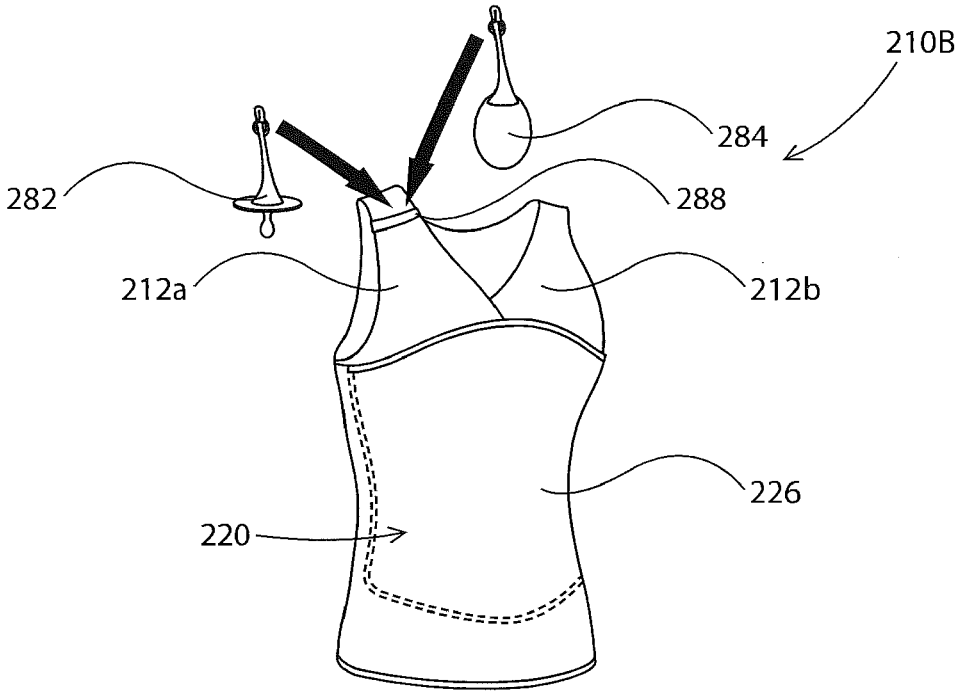

FIG. 7B shows another representative embodiment of the upper body garment 210B. Attached to left breast panel 212*a* is an accessory loop 288 onto which items such as pacifiers 282, rattles 284, or other baby accessories can be placed. Accessory loop 288 is generally attached to left breast panel 212*a* by stitching, bonding or other attachment technique or method.

Figure 7C:
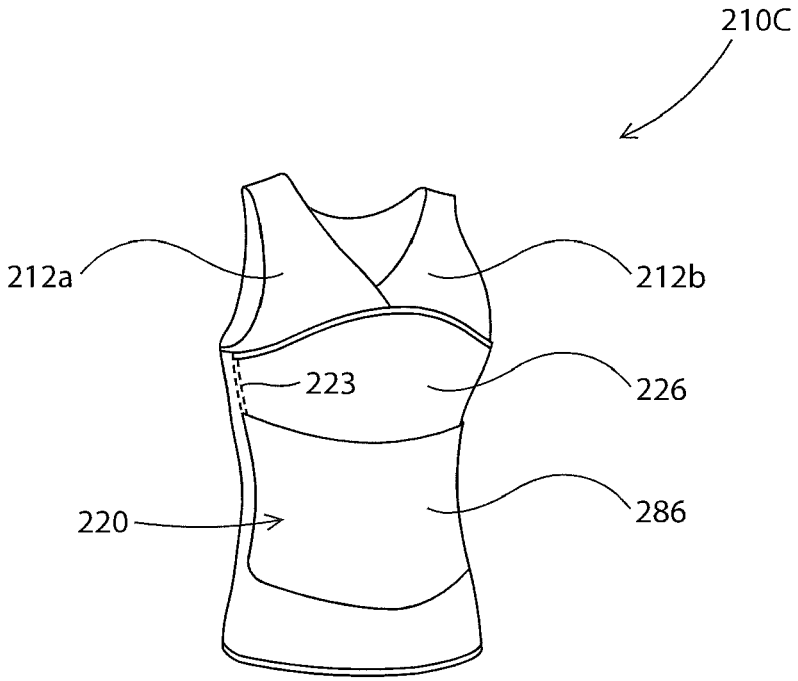
Figure 7D:
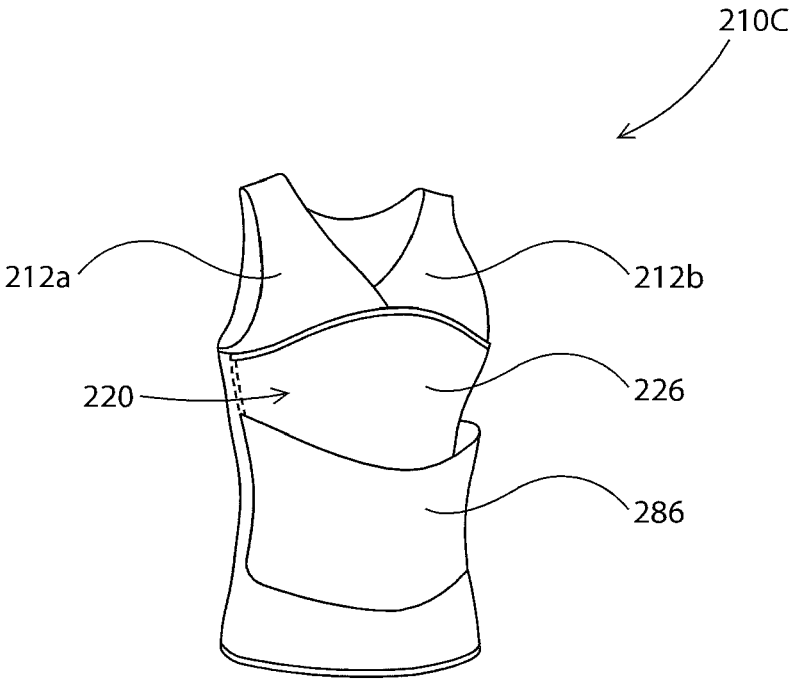

FIGS. 7C-7D show yet another representative embodiment of the upper body garment 210C in which a lower external pouch 286 made from a piece of stretchable fabric or material is attached to the outer panel 226 of the pouch 220 above the attachment line 223 where the inner panel is attached to the outer panel 226. In one aspect, the lower external pouch 286 can be attached to the outer panel 226 along portions of the same attachment line 223 as the inner panel. The lower external pouch 286 can be used to hold objects such as a mobile phone or baby accessories. As shown in FIG. 7D, the lower external pouch 286 can also be made from a stretchable fabric or material so that it can be stretched away from outer panel 226 of the pouch 220 to create a pocket. Although the lower external pouch 286 is shown as being smaller than the pouch 220 which holds the infant, in other aspects it may be the same size.

Figure 8A:
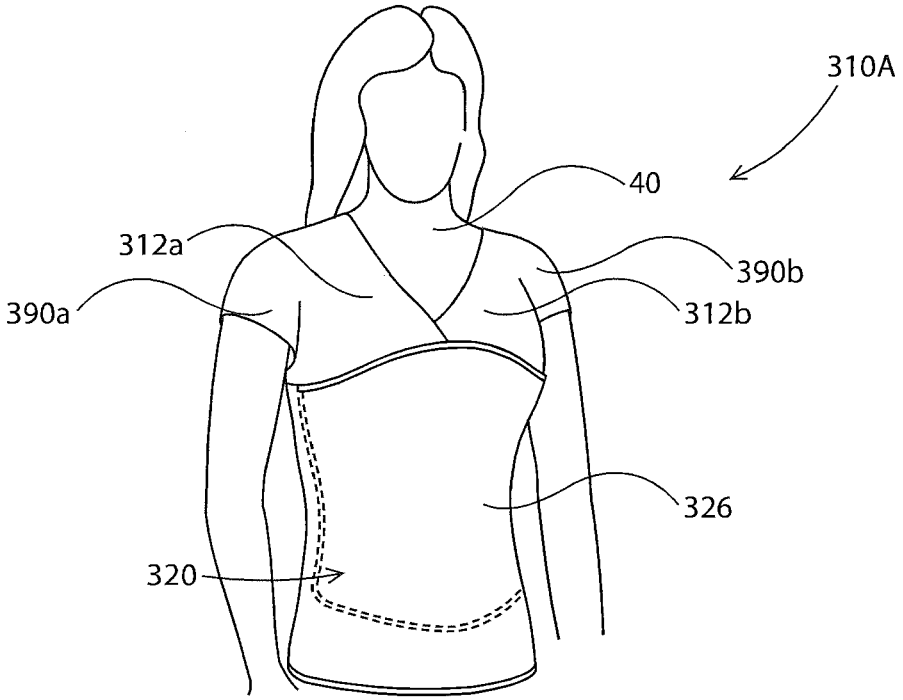
FIGS. 8A-8B are front perspective views of the upper body garment, in accordance with yet another representative embodiment.

FIG. 8A shows another representative embodiment of the upper body garment 310A in which a left short sleeve 390*a* is attached to the left breast panel 312*a* and a right short sleeve 90*b* is attached to right breast panel 312*b*. The short sleeves may be formed as separate pieces from the breast panels and attached by stitching, bonding or other attachment technique or method, or the sleeves and breast panels may be shaped and sewn from a single piece of fabric. FIG. 8A shows the left short sleeve 390*a* and the right short sleeve 390*b* as having a specific length, but they may be shorter or longer than shown.

Figure 8B:
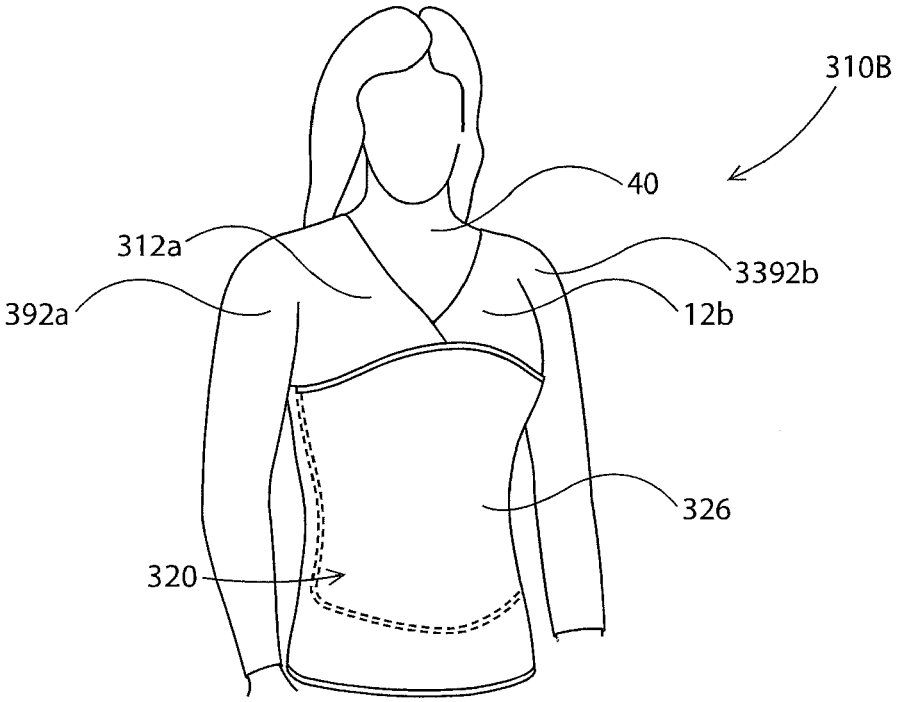

FIG. 8B shows another representative embodiment of the upper body garment 310B in which a left long sleeve 392*a* is attached to the left breast panel 312*a* and a right long sleeve 392*b* is attached to right breast panel 312*b*. The long sleeves may be formed as separate pieces from the breast panels and attached by stitching, bonding or other attachment technique or method, or the sleeves and breast panels may be shaped and sewn from a single piece of fabric. FIG. 8B shows the left long sleeve 392*a* and the right long sleeve 392*b* as having a specific length, but they may be shorter or longer than shown.

Figure 9A:
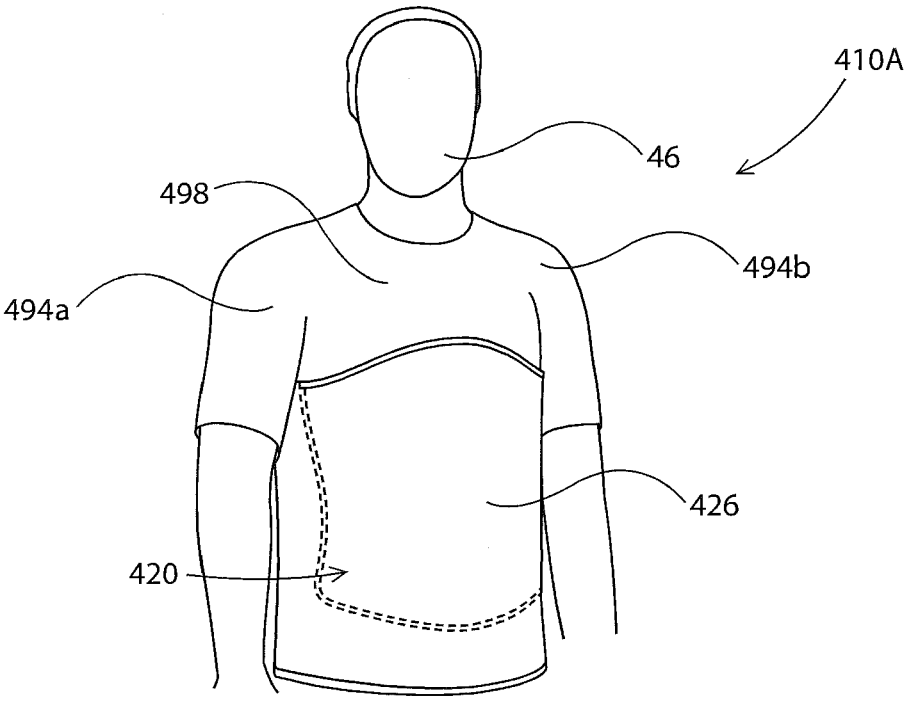
FIGS. 9A-9B are front perspective views of the upper body garment being worn by a woman and by a man, in accordance with yet another representative embodiment.

FIG. 9A shows another representative embodiment of the upper body garment 410A for a male wearer 46 with short sleeves. Both the left short sleeve 494*a* and the right short sleeve 494*b* are attached to the chest portion 498. The short sleeves may be formed as separate pieces from the chest portion 498 and attached by stitching, bonding or other attachment technique or method, or the sleeves and the chest panel may be shaped and sewn from a single piece of fabric. FIG. 9A shows the left short sleeve 494*a* and the right short sleeve 494*b* as having a specific length, but they may be shorter or longer than shown.

Figure 9B:
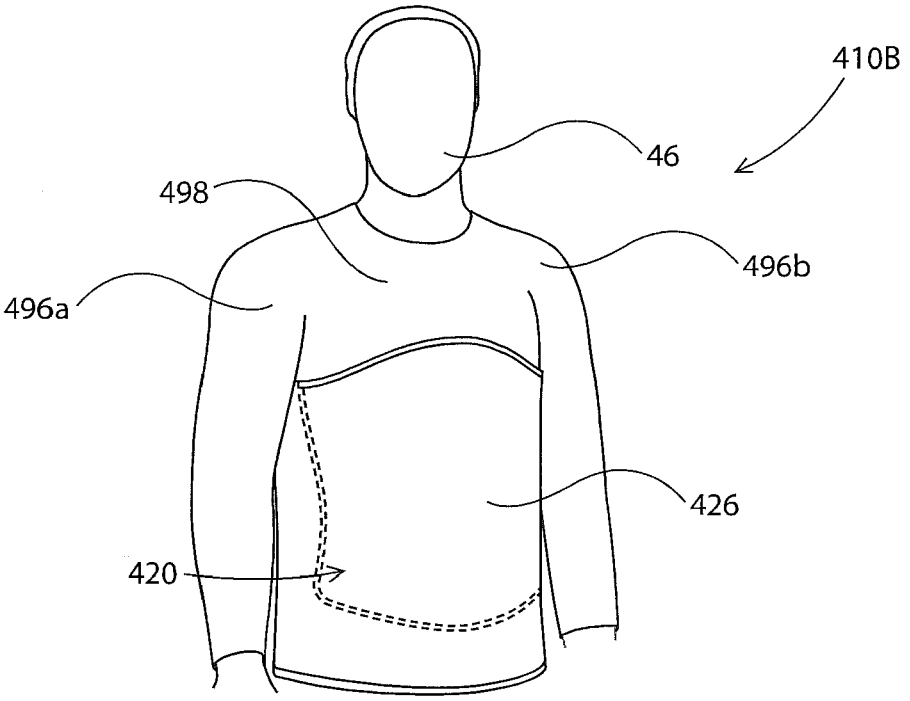

FIG. 9B shows another representative embodiment of the upper body garment 410B for a male wearer 46 having long sleeves. Both the left long sleeve 496*a* and the right long sleeve 496*b* are attached to the chest portion 498. The long sleeves may be formed as separate pieces from the chest portion 498 and attached by stitching, bonding or other attachment technique or method, or the sleeves and the chest panel may be shaped and sewn from a single piece of fabric. FIG. 9B shows the left short sleeve 496*a* and the right short sleeve 496*b* as having a specific length, but they may be shorter or longer than shown.

Figure 10A:
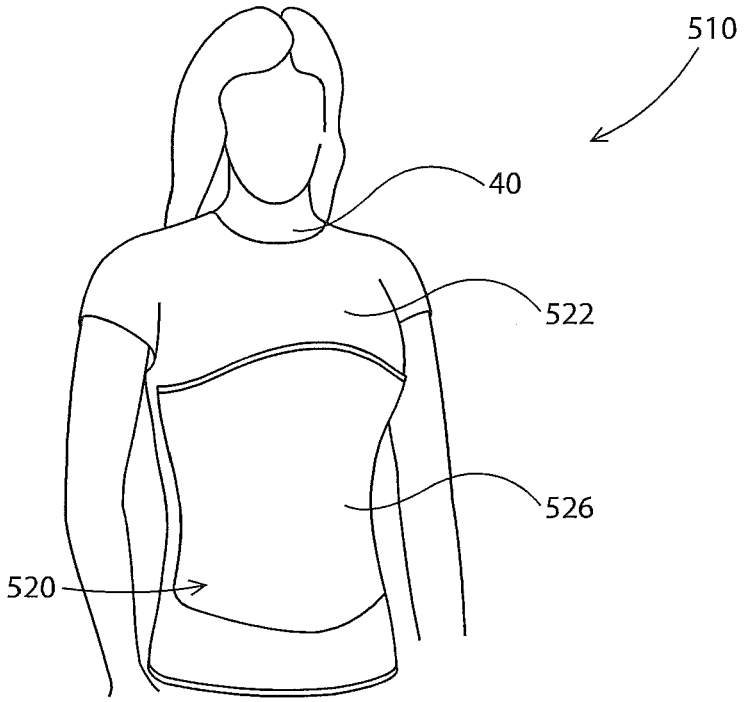
FIGS. 10A-10B are front perspective views of the upper body garment being worn by a woman and by a man, in accordance with yet another representative embodiment.

FIG. 10A shows another representative embodiment of the upper body garment 510 for a female wearer 40 in which the inner panel is not positioned inside the outer panel 526 of the pouch 520 during construction, as shown and described in FIGS. 6A-6B, but instead the inner panel 522 serves as the front portion of the garment 510 that is formed or assembled together first with the back panel of the garment 510. The outer panel 526 is then subsequently attached to the outer surface of the inner panel 522 by stitching, bonding or other attachment technique or method. In this embodiment the outer panel 526 may be formed from a stretchable fabric or material while the rest of the upper body garment 510 may be formed from a different fabric or material that is less stretchable than the fabric forming the outer panel 526.

Figure 10B:
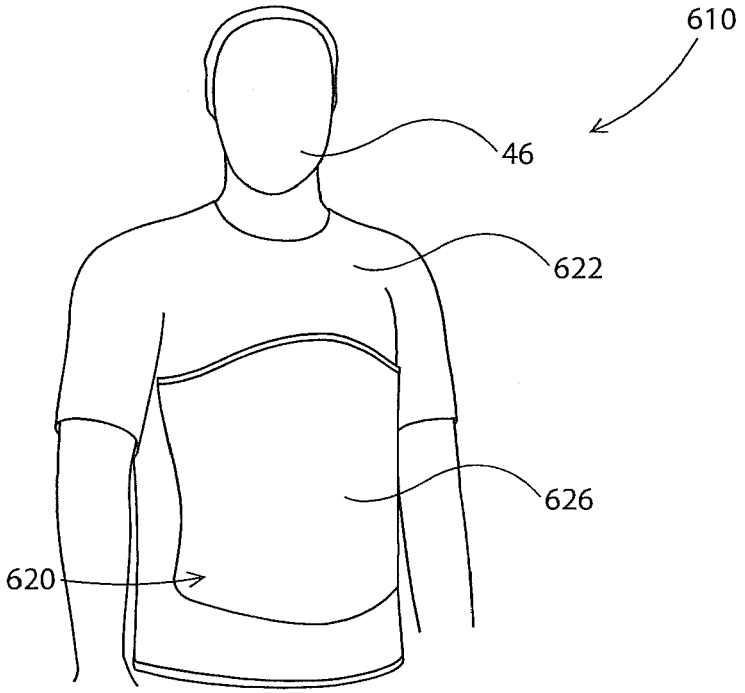

FIG. 10B shows another representative embodiment of the upper body garment 610 for a male wearer 46 in which, like FIG. 10A, the inner panel 622 serves as the front portion of the garment 610 and is formed or assembled together first with the back panel of the garment 610. The outer panel 626 is then subsequently attached to the outer surface of the inner panel 622 by stitching, bonding or other attachment technique or method.

In addition to the above-described features and aspects of the invention, the upper body garment of the present disclosure can provide a number of additional benefits. For instance, the wearer can comfortably and safely carry an infant within the garment, and can walk and move about with the infant in the garment, allowing for greater mobility while carrying the infant. The infant can also sleep while inside the garment. In addition, the user can wear the garment even if no infant is being carried, and the garment can be worn both exposed and underneath other clothing, thereby reducing the number of times the wearer has to put on and take off the garment. In addition, the infant can go in and out of the pouch in public without exposing the user's body.

It will be appreciated that the upper body garment of the present disclosure can also include a built-in nursing bra that provides both support and access, thereby eliminating the need to wear a separate nursing bra while using the garment. As such, the mother can breast feed without removing the garment, while the coverage provided by the garment that covers the entire torso of the wearer can provide for enhanced privacy for both the mother and child during nursing.

As discussed above, the upper body garment can be at least partially made from a fabric that can stretch and expand to provide a uniform degree of tension and to distribute the weight of the infant across a large area, thereby increasing the comfort of both the wearer and the infant. For instance, the fabric can be configured to pull tight against the wearer's body without straps, clasps, belts or ties, making the pouch or pocket in which the baby is carried secure. Moreover, in aspects where each of the back, front, and possibly the pouch panels are made from the stretchable fabric, the fabric can further act as a compression garment to aid in postpartum recovery or to create a slimming effect for the wearer.

The invention has been described above in terms of preferred embodiments and methodologies considered by the inventors to represent the best mode of carrying out the invention. Nevertheless, a wide variety of additions, deletions, and modification might well be made to the illustrated embodiments by skilled artisans within the scope of the invention. These and other revisions might be made by those of skill in the art without departing from the spirit and scope of the invention, and which is constrained only by the following claims.

What is claimed is:

1. An upper body garment for supporting an infant adjacent the chest and upper belly of a wearer, the garment comprising:

a tubular body made from a stretchable fabric and comprising a front panel and a back panel, the front panel extending upward from a bottom edge of the tubular body to an upper edge of the front panel to cover at least the upper belly of the wearer;

at least one breast panel extending from a top portion of the back panel and over the shoulders and chest of the wearer; and a pouch panel extending downward from a lower portion of the at least one breast panel and between the front panel and the back panel, with a bottom edge of the pouch panel being located proximate a mid-belly of the wearer and side edges and the bottom edge of the pouch panel being secured along a U-shaped seam to an inside surface of the front panel to form a pouch, the pouch having a top opening defined by the upper edge of the front panel located proximate the lower portion of the at least one breast panel and a bottom seam spaced above the bottom edge of the tubular body.

2. The upper body garment of claim 1, wherein the stretchable fabric is a two-way stretchable fabric with increased capability for elastic expansion within a substantially horizontal plane when the wearer is in an upright position.

3. The upper body garment of claim 2, wherein the two-way stretchable fabric is at least about three times more stretchable in the horizontal plane than in a vertical plane transverse to the horizontal plane.

4. The upper body garment of claim 1, wherein the front panel and the back panel are configured to stretch together when the front panel is pulled away from the pouch panel to expand the top opening.

5. The upper body garment of claim 1, wherein the at least one breast panel are made from the stretchable fabric.

6. The upper body garment of claim 1, wherein the pouch panel is made from the stretchable fabric.

7. The upper body garment of claim 1, further comprising an elastic breast support at a junction between the at least one breast panel and the pouch panel.

8. The upper body garment of claim 7, wherein the elastic breast support is covered by the front panel when the top opening is not expanded.

9. The upper body garment of claim 1, wherein the tubular body of stretchable fabric is without seams joining the front panel and the back panel.

10. The upper body garment of claim 1, wherein the at least one breast panel comprises two breast panels extending around the neck of the wearer.

11. The upper body garment of claim 1, further comprising a pair of sleeves extending from side portions of the back panel and the at least one breast panel.

12. An upper body garment for supporting an infant adjacent the chest and upper belly of a wearer, the garment comprising:

a tubular body comprising a front panel and a back panel, the front panel extending upward from a bottom edge of the tubular body to an upper edge to cover at least the upper belly of the wearer;

at least one breast panel extending from a top portion of the back panel and over the shoulders and chest of the wearer to a lower portion; and a pouch panel extending downward from the lower portion of the at least one breast panel and between the front panel and the back panel, with a bottom edge of the pouch panel being located proximate a mid-belly of the wearer and side edges and the bottom edge being secured along a U-shaped seam to an inside surface of the front panel to form a pouch with a top opening defined by the upper edge of the front panel located proximate the lower portion of the at least one breast panel and a bottom seam spaced above the bottom edge of the tubular body, wherein at least one of the front panel and the pouch panel is made from a two-way stretchable fabric with increased capability for elastic expansion within a substantially horizontal plane, when the wearer is in an upright position, to expand the top opening of the pouch.

13. The upper body garment of claim 12, wherein the two-way stretchable fabric is at least about three times more stretchable in the horizontal plane than in a vertical plane transverse to the horizontal plane.

14. The upper body garment of claim 12, wherein the pouch panel is secured to an inside surface of the front panel.

15. The upper body garment of claim 14, further comprising an elastic breast support at a junction between the at least one breast panel and the pouch panel.

16. The upper body garment of claim 14, wherein at least the front panel and the back panel are made from the two-way stretchable fabric.

17. The upper body garment of claim 12, wherein the pouch panel is secured to an outside surface of the front panel.

18. A method of making an upper body garment for supporting an infant adjacent the chest and upper belly of a wearer, the method comprising:

obtaining a garment body including:

a tubular body formed from a front panel and a back panel, with the front panel extending upward from a bottom edge of the tubular body to an upper edge of the front panel to cover at least the upper belly of the wearer;

at least one breast panel extending from a top portion of the back panel and configured to cover the shoulders and chest of the wearer; and a pouch panel having side edges and a bottom edge and extending downward from a lower portion of the at least one breast panel, with at least the front panel being made from a stretchable fabric;

inserting the pouch panel between the back panel and the front panel until the bottom edge of the pouch panel is positioned proximate a mid-belly of the wearer; and securing the side edges and the bottom edge of the pouch panel to an inside surface of the front panel along a U-shaped seam to form a pouch with a top opening defined by the upper edge of the front panel located proximate the lower portion of the at least one breast panel and a bottom seam spaced above the bottom edge of the tubular body.

19. The method of claim 18, further comprising:

securing an elastic breast support to the lower portion of the at least one breast panel; and securing the pouch panel to the at least one elastic breast support.

20. The method of claim 18, wherein the stretchable fabric is a two-way stretchable fabric with increased capability for elastic expansion within a substantially horizontal plane when the wearer is in an upright position.

21. The method of claim 20, wherein the two-way stretchable fabric is at least about three times more stretchable in the horizontal plane than in a vertical plane transverse to the horizontal plane.

* * * * *